US007738668B2

(12) United States Patent
Lin

(10) Patent No.: US 7,738,668 B2
(45) Date of Patent: Jun. 15, 2010

(54) ELECTRICAL CONTACT ARRANGEMENT FOR HEARING INSTRUMENTS

(75) Inventor: Shin Chai Mark Lin, Millburn, NJ (US)

(73) Assignee: Siemens Hearing Instruments, Inc., Piscataway, NJ (US)

( * ) Notice: Subject to any disclaimer, the term of this patent is extended or adjusted under 35 U.S.C. 154(b) by 1049 days.

(21) Appl. No.: 10/092,685

(22) Filed: Mar. 7, 2002

(65) Prior Publication Data

US 2003/0169894 A1 Sep. 11, 2003

(51) Int. Cl.
*H04R 25/00* (2006.01)

(52) U.S. Cl. ..... 381/323; 381/314

(58) Field of Classification Search ..... 381/312, 381/314–315, 322–324, 330
See application file for complete search history.

(56) References Cited

U.S. PATENT DOCUMENTS 5,687,242 A * 11/1997 Iburg ..... 381/312
5,784,470 A * 7/1998 Fackler et al. ..... 381/328
5,799,095 A 8/1998 Hanright ..... 381/68
5,915,031 A * 6/1999 Hanright ..... 381/323
6,088,465 A 7/2000 Hanright et al. ..... 381/323
6,678,386 B2 * 1/2004 Robinson et al. ..... 381/323
2004/0052390 A1 * 3/2004 Morales et al. ..... 381/323

FOREIGN PATENT DOCUMENTS

EP 0 681 412 A2 11/1995

OTHER PUBLICATIONS

Embedded. Answers.com. The American Heritage® Dictionary of the English Language, Fourth Edition, Houghton Mifflin Company, 2004. http://www.answers.com/topic/embedding, accessed May 21, 2008.*

* cited by examiner

*Primary Examiner*—Fan Tsang
*Assistant Examiner*—Phylesha Dabney

(57) ABSTRACT

A space-saving electrical contact assembly for a hearing instrument faceplate can be fashioned by physically conforming the configuration of individual contacts to the battery and the battery door in the faceplate. By providing each contact of the assembly with an interconnected terminal, the wiring of the assembly is reduced.

18 Claims, 3 Drawing Sheets

ELECTRICAL CONTACT ARRANGEMENT FOR HEARING INSTRUMENTS

BACKGROUND OF THE INVENTION

As shown in U.S. Pat. Nos. 5,118,540; 5,799,095; and 6,088,465; incorporated by reference herein, a hearing instrument may be provided with electrical contacts in the faceplate to facilitate programming and adjustment. For in-the-ear hearing instruments, internal space, i.e, within the instrument, is at a premium and the contacts necessarily occupy some portion of this space. To fit properly and comfortably within the user's ear, the size of the instrument must be kept as small as possible.

DESCRIPTION OF THE INVENTION

The space required for the electrical contacts can be minimized by physically conforming them to the battery receptacle and door. This arrangement reduces the wiring needed for the hearing instrument and eases manufacturing. Moreover, it permits a smaller volume for the hearing instrument.

Figure 1:
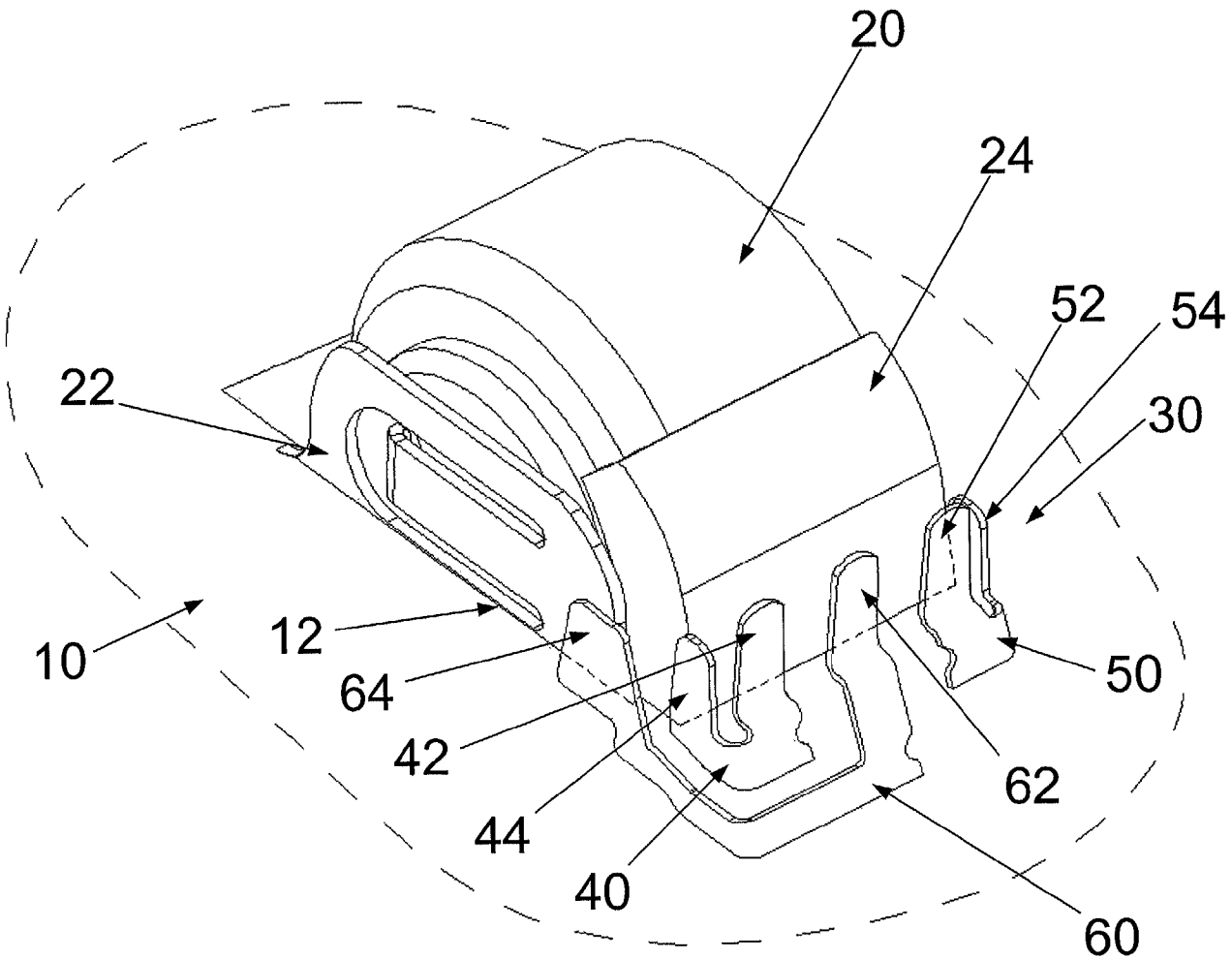
FIGS. 1 and 2 are perspective drawings of a hearing instrument faceplate having a battery receptacle, a microphone, and a programming contact assembly.
Figure 2:
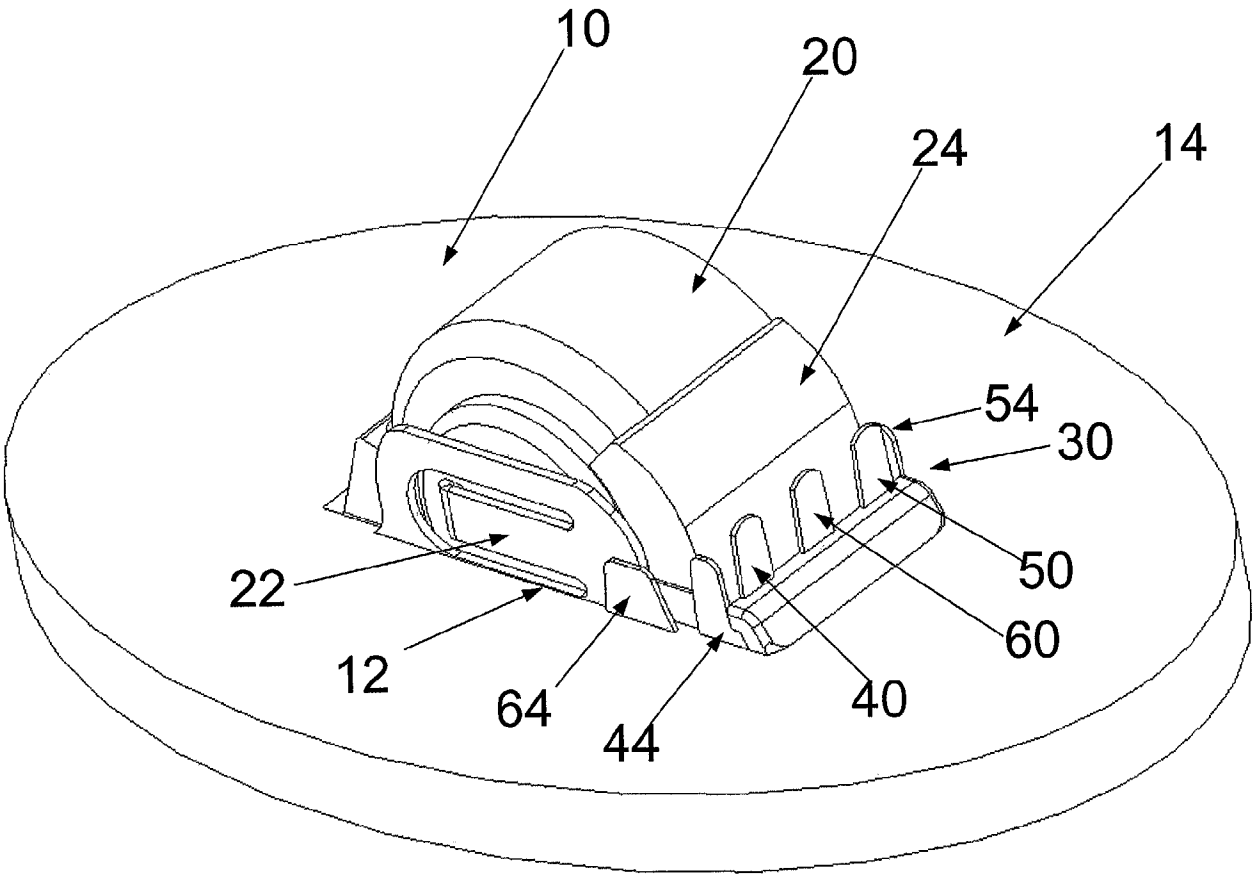

A hearing instrument faceplate 10, a battery 20, a battery door 24, a battery support contact 22, and a programming contact assembly 30 are illustrated in FIG. 1 (illustrating the faceplate in phantom) and FIG. 2. The battery door 24 resides in an opening 12 in the faceplate 10 while the programming contact assembly 30 is adjacent to the battery door 24 and is arranged to generally conform to the door 24. The battery 20, the battery support contacts 22, and the battery door 24 protrude vertically away from the surface 14 of the faceplate 10. Taking note of FIG. 1, it should be understood that this surface 14 would be inside the hearing instrument, the outer surface (not shown) being below.

Although the programming contact assembly 30 shows three distinct contacts 40, 50, and 60, any number of contacts could have been provided. The faceplate 10 can be fabricated by injection molding, during which the battery support contacts 22 and the programming contact assembly 30 are held in place.

Figure 4:
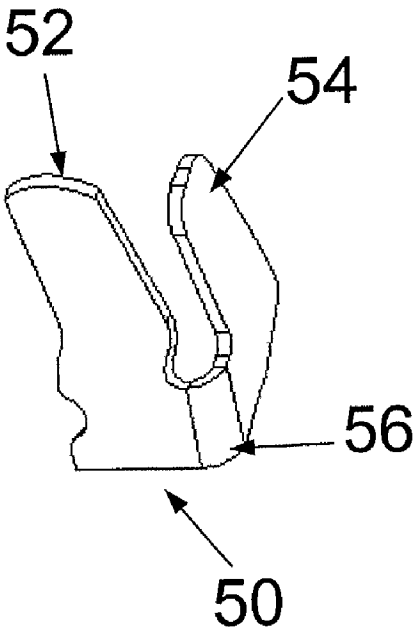
FIGS. 3-5 are perspective views of the individual contacts comprising the programming contact assembly shown in FIG. 1.
Figure 5:
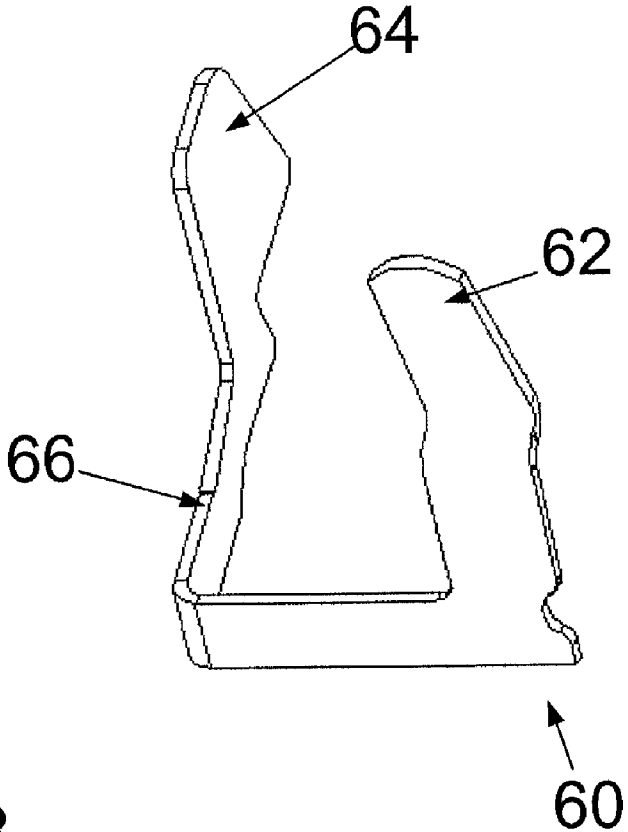
Figure 3:
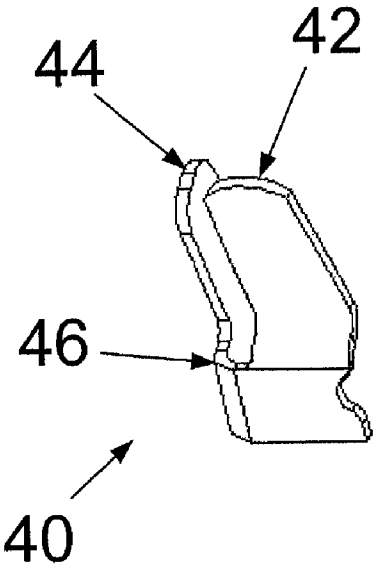

In the particular arrangement shown in FIG. 1, there are two outer contacts 40 and 50, and a center contact 60 which conform to the space adjacent the battery 20 and the battery door 24. As illustrated in the perspective views of FIGS. 3-5, each of the contacts has a contact portion 42, 52, or 62 that lies in a plane generally adjacent the door 24 and a terminal portion 44, 54, or 64, respectively, oriented in a different plane with respect to the corresponding contact portions 42, 52, or 62. In the figures, these planes are roughly at right angles although-other orientations may be used. As illustrated, the contact portions 42, 52, and 62 extend generally vertically from the inner surface 14 of faceplate 10, although tilting or curving somewhat towards the battery door 24. To reach this orientation, it may be necessary to apply pressure to and bend the contact portions 42, 52, and 62 towards the door 24.

The contacts 40, 50, and 60 have intermediate interconnection portions 46, 56, and 66 between the respective contact and terminal portions. As shown in FIG. 1, at least a portion of each of the interconnection portions 46, 56, and 66, and possibly portions of the contact portions 42, 52, and 56, and the terminal portions 44, 54, and 64 are embedded within the faceplate 10.

In the drawings (e.g., FIG. 1), the terminal portion 64 of contact 60 is adjacent the battery support contact 22 and the two items may be either soldered or spot welded together. The other contacts 40 and 50 may be connected to wires (not shown) soldered or spot welded to the respective terminal portions 44 and 54.

The material used to fabricate the contacts 40, 50, and 60 must be flexible enough to allows the contact portions 42, 52, and 62 to flex but not so soft that they will not maintain there general shape during the injection molding process. Beryllium copper and stainless steel have been found to perform satisfactorily.

What is claimed is:

1. A modular assembly for a hearing instrument, comprising:

a faceplate;

a battery door in the faceplate; and an electrical programming contact assembly partially affixed to the faceplate and generally adjacent and conforming to the contour of the battery door, where the electrical programming contact assembly is partially embedded in the faceplate.

2. An assembly as set forth in claim 1, where the faceplate comprises a generally rectangular opening; and the battery door resides within the generally rectangular opening.

3. An assembly as set forth in claim 1, where the electrical programming contact assembly comprises at least one contact, where each contact comprises a contact portion and a terminal portion generally adjacent and conforming to the contour of the battery door, and an interconnection portion, interconnecting the contact and terminal portions, where the interconnecting portion is at least partially embedded in the faceplate.

4. An assembly as set forth in claim 3, where the faceplate comprises a generally rectangular opening; and the battery door resides within the generally rectangular opening.

5. An assembly as set forth in claim 3, further comprising battery contacts and where the terminal portion of at least one of the contacts comprises a section extending to one of the battery contacts.

6. An assembly as set forth in claim 5, where the section of the terminal portion extending to one of the battery contacts passes through the faceplate.

7. An electrical programming contact assembly for a faceplate of a hearing instrument, where the faceplate comprises a battery door and the assembly is partially affixed to the faceplate and generally adjacent and conforming to the contour of the battery door, where the electrical programming contact assembly is partially embedded in the faceplate.

8. An assembly as set forth in claim 7, where the faceplate comprises a generally rectangular opening; and the battery door resides within the generally rectangular opening.

9. An assembly as set forth in claim 7, where the electrical programming contact assembly comprises at least one contact, where each contact comprises a contact portion and a terminal portion generally adjacent and conforming to the contour of the battery door, and an interconnection portion, interconnecting the contact and terminal portions, where the interconnecting portion is at least partially embedded in the faceplate.

10. An assembly as set forth in claim 9, where the faceplate comprises a generally rectangular opening; and the battery door resides within the generally rectangular opening.

11. An assembly as set forth in claim 9, where the hearing instrument further comprises battery contacts and where the terminal portion of at least one of the contacts comprises a section extending to one of the battery contacts.

12. An assembly as set forth in claim 11, where the section of the terminal portion extending to one of the battery contacts passes through the faceplate.

13. An electrical programming contact for a faceplate of a hearing instrument, where the faceplate comprises a battery door and the contact is partially affixed to the faceplate and generally adjacent and conforming to the contour of the battery door; where the contact is partially embedded in the faceplate.

14. An electrical programming contact as set forth in claim 13, where the faceplate comprises a generally rectangular opening; and the battery door resides within the generally rectangular opening.

15. An electrical programming contact as set forth in claim 13, where the electrical programming contact comprises a contact portion and a terminal portion generally adjacent and conforming to the contour of the battery door, and an interconnection portion, interconnecting the contact and terminal portions, where the interconnecting portion is at least partially embedded in the faceplate.

16. An electrical programming contact as set forth in claim 15, where the faceplate comprises a generally rectangular opening; and the battery door resides within the generally rectangular opening.

17. An electrical contact as set forth in claim 15, where the hearing instrument further comprises battery contacts and where the terminal portion of at least one of the contacts comprises a section extending to one of the battery contacts.

18. An assembly as set forth in claim 17, where the section of the terminal portion extending to one of the battery contacts passes through the faceplate.

* * * * *